US008991788B2

(12) United States Patent
Mueller

(10) Patent No.: US 8,991,788 B2
(45) Date of Patent: Mar. 31, 2015

(54) LIFTING PLATFORM

(76) Inventor: Peter A. Mueller, Gattikon (CH)

( * ) Notice: Subject to any disclaimer, the term of this patent is extended or adjusted under 35 U.S.C. 154(b) by 0 days.

(21) Appl. No.: 13/980,400

(22) PCT Filed: Jan. 20, 2012

(86) PCT No.: PCT/CH2012/000013
§ 371 (c)(1),
(2), (4) Date: Oct. 7, 2013

(87) PCT Pub. No.: WO2012/097465
PCT Pub. Date: Jul. 26, 2012

(65) Prior Publication Data

US 2014/0026805 A1 Jan. 30, 2014

(30) Foreign Application Priority Data

Jan. 20, 2011 (CH) ..... 103/11

(51) Int. Cl.
*B63B 27/14* (2006.01)
*B63B 27/36* (2006.01)

(52) U.S. Cl.
CPC ..... *B63B 27/14* (2013.01); *B63B 27/143* (2013.01); *B63B 27/36* (2013.01)
USPC ..... 254/10 R; 254/10 C; 254/10 B; 114/259

(58) Field of Classification Search
USPC ..... 254/10 B, 10 C, 10 R; 414/556–558; 114/259, 369
See application file for complete search history.

(56) References Cited

U.S. PATENT DOCUMENTS

| | | | | | |
|---|---|---|---|---|---|
| 2,603,454 | A | * | 7/1952 | Newton et al. | 254/10 C |
| 2,676,720 | A | * | 4/1954 | Noble | 414/462 |
| 2,683,539 | A | * | 7/1954 | Corley, Jr. | 414/557 |
| 3,138,270 | A | * | 6/1964 | McCarty | 414/558 |
| 3,369,678 | A | * | 2/1968 | Robinson | 414/558 |
| 3,474,921 | A | * | 10/1969 | Rossoni | 414/557 |
| 3,666,121 | A | * | 5/1972 | Denner et al. | 414/558 |
| 5,690,045 | A | | 11/1997 | Gauthier | |

(Continued)

FOREIGN PATENT DOCUMENTS

| | | | |
|---|---|---|---|
| CA | 2 333 867 | A1 | 5/2001 |
| CA | 2333867 | A1 * | 5/2001 |

(Continued)

OTHER PUBLICATIONS

Aug. 1, 2012 International Search Report issued in International Patent Application No. PCT/CH2012/000013.

(Continued)

*Primary Examiner* — Lee D Wilson
*Assistant Examiner* — Tyrone V Hall, Jr.
(74) *Attorney, Agent, or Firm* — Oliff PLC

(57) ABSTRACT

The invention relates to a three-armed pivot system, the two upper pivot arms having a V shape and representing part of a parallelogram, and the lower arm being a single, centrally situated pivot arm which represents the second part of the parallelogram. The active cylinder is assisted by a gas spring, and a personal protection safety net covers the gap between the vehicle and the platform, which may optionally be horizontally displaced. The active cylinder has a lift sensor which is connected to the controller, and the offset positioning of the active cylinder with respect to the bracket and of the fastening point to the pivot arm or support produces an improved lifting force.

16 Claims, 3 Drawing Sheets

(56) References Cited

U.S. PATENT DOCUMENTS

| | | | | |
|---|---|---|---|---|
| 6,327,992 | B1 * | 12/2001 | Martin | 114/259 |
| 6,786,170 | B2 * | 9/2004 | Trowbridge | 114/259 |
| 7,707,955 | B1 * | 5/2010 | Johns et al. | 114/259 |
| 2010/0102419 | A1 | 4/2010 | Pan | |

FOREIGN PATENT DOCUMENTS

| | | | |
|---|---|---|---|
| DE | 196 02 331 | A1 | 7/1997 |
| WO | WO 2004/022421 | A1 | 3/2004 |
| WO | WO 2007/087736 | A1 | 8/2007 |
| WO | WO 2008/138151 | A1 | 11/2008 |
| WO | WO 2008138151 | A1 * | 11/2008 |
| WO | WO 2010/006167 | A2 | 1/2010 |
| WO | WO 2010006167 | A2 * | 1/2010 |
| WO | WO 2010/102419 | A2 | 9/2010 |

OTHER PUBLICATIONS

Aug. 1, 2012 Written Opinion of the International Searching Authority issued in International Patent Application No. PCT/CH2012/000013.

Jul. 23, 2013 International Preliminary Report on Patentability issued in International Patent Application No. PCT/CH2012/000013.

* cited by examiner

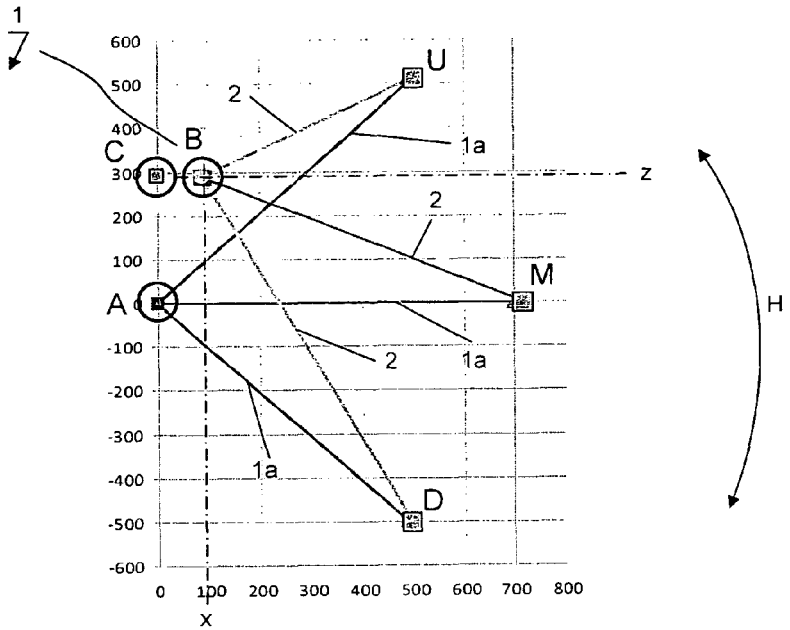

| | |
|---|---|
| Load from intrinsic weight: | 1500 N |
| Load from tender: | 5000 N |
| Total load: | 8500 N |

| | |
|---|---|
| Length of crossbeam: | 700 mm |
| Lift: | 1000 mm |

| | |
|---|---|
| Start angle: (crossbeam at top): | 45.6° |
| End angle: (crossbeam at bottom): | −45.6° |
| Res. x displacement: | 0.0 mm |

| | |
|---|---|
| Cylinder lift: | 433.8 mm |
| Cylinder reserve: | 37.0 mm |

| | Coordinates | |
|---|---|---|
| | X (mm) | Z (mm) |
| Crossbeam pivot: | 0 | 0 |
| End point of crossbeam at top: | 489.9 | 500 |
| End point of crossbeam at bottom: | 489.9 | −500 |

| | Coordinates | | Cylinder length (mm) |
|---|---|---|---|
| | X (mm) | Z (mm) | |
| Cylinder support: | 90 | 290 | |
| Fastening point of cylinder to horizontal crossbeam: | 720.0 | 0 | 693.5 |
| Fastening point of cylinder to crossbeam at top: | 503.9 | 514.3 | 470.8 |
| Fastening point of cylinder to crossbeam at bottom: | 503.9 | −514.3 | 904.5 |

| | Crossbeam position | | |
|---|---|---|---|
| | Top | Horizontal | Bottom |
| Load torque (Nm): | 3184 | 4550 | 3184 |

| | Crossbeam position | | |
|---|---|---|---|
| | Top | Horizontal | Bottom |
| Vertical distance from cylinder to crossbeam pivot (mm): | −212.1 | −301.1 | −212.7 |

| | Crossbeam position | | |
|---|---|---|---|
| | Top | Horizontal | Bottom |
| Cylinder force (kN): | −15.9 | −15.1 | −15.0 |

Fig 5

LIFTING PLATFORM

TECHNICAL FIELD

The invention is directed to a height-adjustable, elastic force-assisted platform for accommodating tenders and persons for watercraft, or for trucks, in particular having three pivot arms and an active cylinder, separately affixed to the fastening bracket and assisted by a gas spring, according to the preamble of Claim 1.

PRIOR ART

Lowerable platforms, in particular for swimmers and divers and for tender vehicles, as described in patents DE 196 02 331, U.S. Pat. No. 6,327,992, and U.S. Pat. No. 5,690,045, are known. These platforms allow persons or materials to be conveniently placed in the water or brought on board.

Lowerable tailgate lifts have been known for decades, and are all very similar in their use and basic function.

In watercraft having surface drives which have a relatively long drive shaft just below the waterline behind the vehicle level, a lowerable swimming platform, for example, is made possible via a horizontal displacement of the platform which is electrically or hydraulically activated via a guide led at the water level, and thus avoids the drive, transverse thruster, and other technical equipment in a contactless manner. An extendable platform of this generic type is described in the patent WO 2007/087736 A1, among others.

DESCRIPTION OF THE INVENTION

The object of the invention, on a vehicle of any type, in the present case a watercraft by way of example, having a height-adjustable platform for accommodating items such as a tender or persons or lowering same into the water, by means of a three-legged pivot means, hereinafter referred to as a tripod, from the Greek word for "three foot," which allows high stability and at the same time, reduced system weight. In addition, the position of the working means is central, on the one hand to lift an item using less force, and on the other hand to conserve space, and if necessary, also to use space for the displacement of the platform as well as to reduce or additionally control the lifting forces by attaching springs or even controlled working means.

The weight and space requirements of a lowerable platform are a key issue for any vehicle, as well as the problem that persons could be injured by the pivot arms and other rotating elements on such a movable platform; therefore, the risk of injury should be prevented to the greatest extent possible by using electronic security means and mechanical or design optimization of the equipment. Since most pivot drives are based on the principle of a parallelogram, and large lifts with small dimensions are usually desired, the pivot arms are very often situated very close together, resulting in a corresponding risk of crushing of body parts. A greater distance between the pivot arms increases the weight and requires more space. The invention displaces the pivot arms to the side, but retains the parallelogram principle, so that wedging of body parts is ruled out. In addition, the lower, fourth pivot arm is dispensed with; i.e., the remaining lower pivot arm is centrally positioned for this purpose and designed with appropriate strength, while still conserving space and weight, and is connected to the active cylinder via a short distance. The active cylinder, which is hydraulically or electrically driven, must be appropriately placed, since the correct positioning of this element has a great influence on the lifting forces to be applied to the active cylinder, and also has an influence on the size of the storage space and other technical equipment on such a pivotable platform. For this reason, an algorithm has been developed which allows a simple but very good approximation of a geometry which for constant defined dimensions allows a given weight to be lifted with optimal application of force, and independently of the angular position of the stern of a vehicle.

Due to the compact pivot system, sufficient space is available to additionally install a gas spring, for example, which in the case of emergency makes it possible to ensure, by depressurization of the hydraulic system, or free running for an electric cylinder, that the system is always brought to the original starting point, and/or assists the active cylinder in the application of lifting force. A corresponding gas spring block ensures that a position is maintained once it is started. An electronics system having a sensor may additionally assist this function by automatically making a correction if the actual value deviates from the setpoint value, during travel or even with the platform lowered. Furthermore, the platform may be additionally horizontally displaced using equipment, and likewise assisted by gas springs.

In addition, located between the vehicle and the platform is an extendable personal protection safety net, having integrated stairs, which safely covers the gap between the vehicle and the platform and which is essential for persons present on a platform that is lowered, and thus underwater, due to the risk of wave surges and flow which may push against the stern of the vehicle. The personal protection safety net, which is retractable linearly or by rolling, may likewise be used as an aid for the platform lifting.

According to the invention, this is achieved by the features of claim 1.

The core of the invention is to implement, by means of a three-armed pivot unit, a platform which is robust yet easily lowerable, and which allows an effective reduction in the lifting forces due to a specific geometry of the active cylinder placement, and which by use of a gas spring allows the lifting forces to be further reduced, and which imparts a high degree of lateral stability to the pivot unit due to the spreading of the pivot arms.

Further advantageous embodiments of the invention result from the subclaims.

BRIEF DESCRIPTION OF THE DRAWINGS

Exemplary embodiments of the invention are explained in greater detail below with reference to the drawings. Identical elements are provided with the same reference numerals in the various figures.

The drawings show the following:

FIG. 5 shows a geometric illustration of a pivot arm and an active cylinder in three lift positions, together with an Excel table.

Only the elements which are essential for the direct understanding of the invention are schematically shown.

Approach to Carrying Out the Invention

Figure 1:
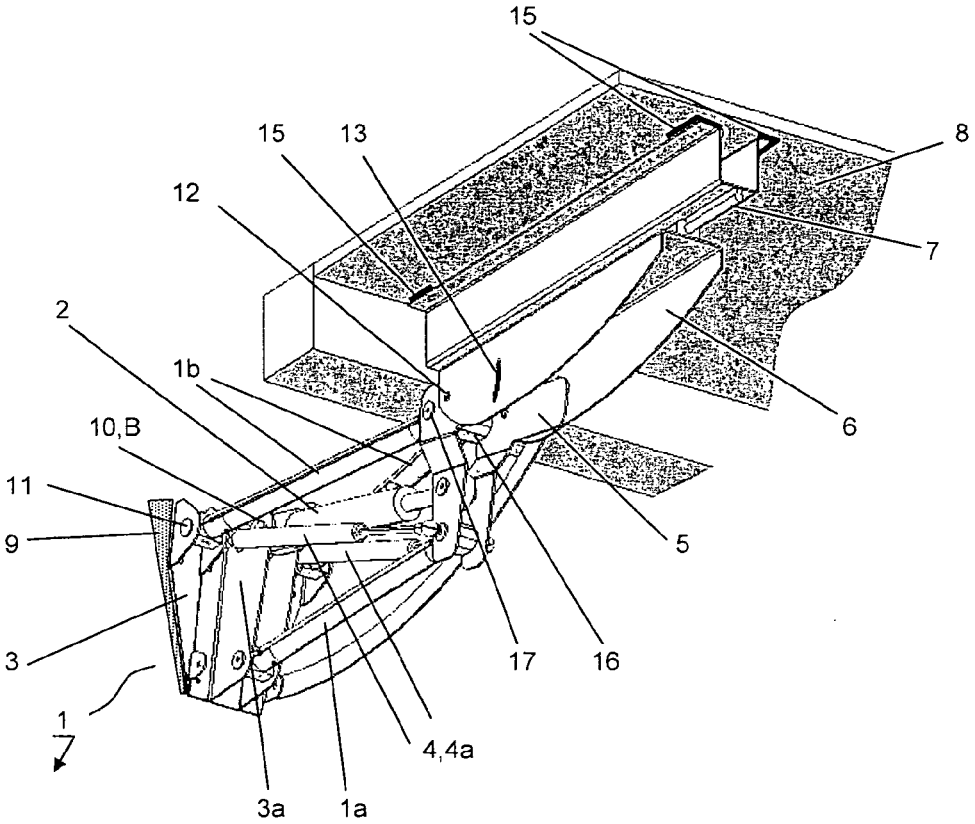
FIG. 1 shows a three-dimensional view of a pivot part having two upper pivot arms, a centrally located lower pivot arm with the active cylinder and two gas springs therebetween, a bracket having an exchangeable wedge, and a platform which is movable both vertically and horizontally.

FIG. 1 shows a three-dimensional view of the left pivot part 1 of a lowerable platform 8, which on each side has an identical pivot part 1, or for small facilities, only one centrally located pivot part 1, having a bracket 3 on which two upper pivot arms 1*b* and a centrally located pivot arm 1*a*, situated therebeneath, are mounted, in between which the active cylinder 2 together with two laterally mounted gas springs 4, which dock on a support 5 on which the alignment plate 6, together with a displacement element 7, is rotatably supported. The platform 8 is mounted on the displacement element 7 so as to be longitudinally displaceable. A wedge 9 is also situated on the bracket 3.

In addition to a sophisticated kinematics system for thus reducing the lifting forces as shown in FIG. 5, the robust and yet lightweight pivot arm mechanical system is key to a pivot system 1. The parallelogram of the pivot system 1 is composed of the two upper pivot arms 1*b* and a single centrally positioned pivot arm 1*a*, instead of the customary two pivot arms, which for this purpose has a strong design, with which the active cylinder 2 engages. Due to the configuration of three pivot arms 1*a*, 1*b* in a tripod position, this shape on the one hand provides the best stability in the lateral direction, and on the other hand meets the requirement for a parallelogram. The corresponding dimensional position of the pivot arm 1*a* with respect to the pivot arms 1*b* also ensures that body parts of persons and animals are not injured, but also that the mechanical system, due to deadwood, cannot jam therein, and allows sufficient space for additional technical equipment while at the same time having a more lightweight design.

The flatly situated active cylinder 2 is mounted within the tripod 1*a*, 1*b*; ideally, the upper pivot 10 of the active cylinder 2 is not located on the same rotational axis 11 of the pivot arms 1*b*, and is therefore fastened in a rotatably supported manner to the protruding center part 3*a* of the bracket 3, and on the opposite side is fastened directly to the support 5 or to the pivot arm 1*a*. The active cylinder 2 may also be mounted with rubber bearings for noise damping; its task is to move the platform 8 up or down, and it may be operated using fluid, or operated electrically. To relieve load on the active cylinder 2, one or two gas springs 4 may be mounted at the side of the pivot lever 1*a*, the gas springs on the one hand being mounted on the bracket 3, and on the other hand mounted on the support 5, and ensuring that in the event of failure of the active cylinder 2, for example, the force of the gas springs 4 is used to independently raise the platform 8.

Such a configuration drastically alters the philosophy of lifting platforms or of a pivot part 1: instead of, as is customary, braking a platform 8 downwardly and pushing up the platform 8, possibly with a load, using considerable force, in the present design the active cylinder 2, even during lowering of the platform 8, is required to deliver significant power, namely, to push against the gas spring force of the gas spring 4. In turn, it is possible for the gas spring 4 to passively move the platform 8 upwardly without effort, and, depending on the configuration, to thus lift even additional weight without assistance from the working force of the active cylinder 2.

The support 5 has a movable alignment plate 6 by means of which the inclination of the platform 8 at the adjustment point 12 is adjusted, and is blocked by means of the angle bracket 13, which may be a screw or clamp connection. Hoisting lifts on vehicles are often appropriately aligned on the bracket by means of additional perforated plates and pivot bearings. However, since it can be expected that series production vehicles will always have the same or at least similar inclinations, for example at the water level of a watercraft, this type of complicated adjustment is not necessary, and in terms of lifting forces may even be detrimental to the geometry. For special cases in the sense of stern angle adjustment, an appropriate wedge 9 provided with the correct inclination is therefore used which has through holes and is situated between the bracket 3 and the stern of a vehicle 14, and specifies the appropriate inclination. Thus, the optimized design of the pivot arms 1*a* and the active cylinder 2, having the pivot positions A, B, C, in FIG. 5 always remains constant. An additional fixing plate may be mounted on the inner side of the stern of the vehicle 14, so that the entire assembly may be securely screwed together, possibly with additional support within the vehicle 14, in order to prevent detachment of the bracket 3 or formation of cracks at the stern of the vehicle 14 under high stresses. The fine adjustment of the platform 7 by means of the alignment plate 6 is therefore completely sufficient, and to this end is more lightweight and inexpensive, and at the same time may also accommodate a displacement element 7 in an elegant manner. Furthermore, the platform 8 is not fixedly connected to the pivot system 1 by means of an elastic bearing 15, so that lateral impacts or vertical wave washing do not completely penetrate the mechanical system, but, rather, are held in position by the elastic bearing 15 and the cone 29 shown in FIG. 4; however, under high stresses they create an elastic effect instead of imposing unnecessary stress on the stern of a vehicle 14 by means of a rigid catch hook.

The two upper pivot arms 1*b* are blocked by means of a spacer element 16, and thus provide an advantageous, broadly supported bearing of the bearing bolt 17.

Figure 3:
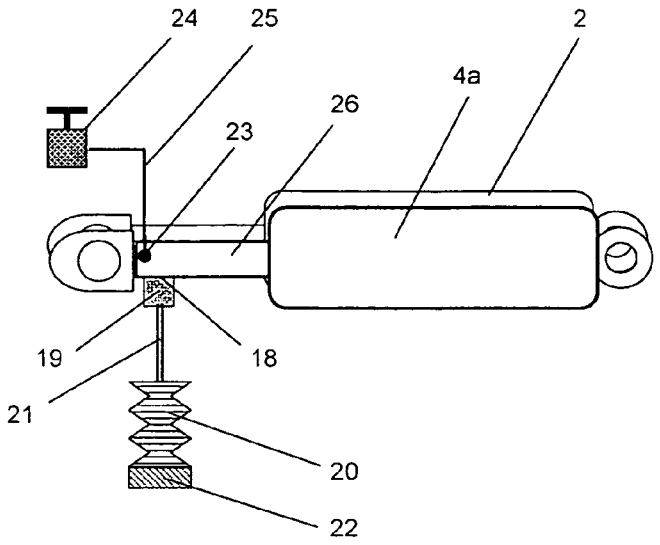
FIG. 3 shows a schematic side view of an electrically blockable gas traction spring together with an air filter and bellows, as well as a dehumidifying agent.

The active cylinder 2 may be an electric active cylinder having a self-locking spindle, and in the event of failure the lift H may be manually synchronously adjusted by means of mechanical synchronization (not shown here) for up to two active cylinders 2, or the active cylinder 2 is an electric active cylinder having a nonself-locking spindle, and in the event of failure the platform 8 may be moved upwardly according to the lift H by releasing the unblocking of a blockable gas spring 4 as shown in FIG. 3, or the active cylinder 2 is a hydraulic active cylinder, and in the event of failure of the hydraulic system or the electrical system, the pressure in the active cylinder 2 may be completely relieved by means of a manually activated depressurization valve, and the platform 8 may be raised back into the original, upper position by unblocking the gas spring 4.

In addition, in-house testing has shown that nibral, an alloy of nickel, bronze, and aluminum, has excellent corrosion resistance in salt water and has negligible vegetative growth on the material; in addition, for a pivot system 1 it has very good strength and good machining capability.

Figure 2:
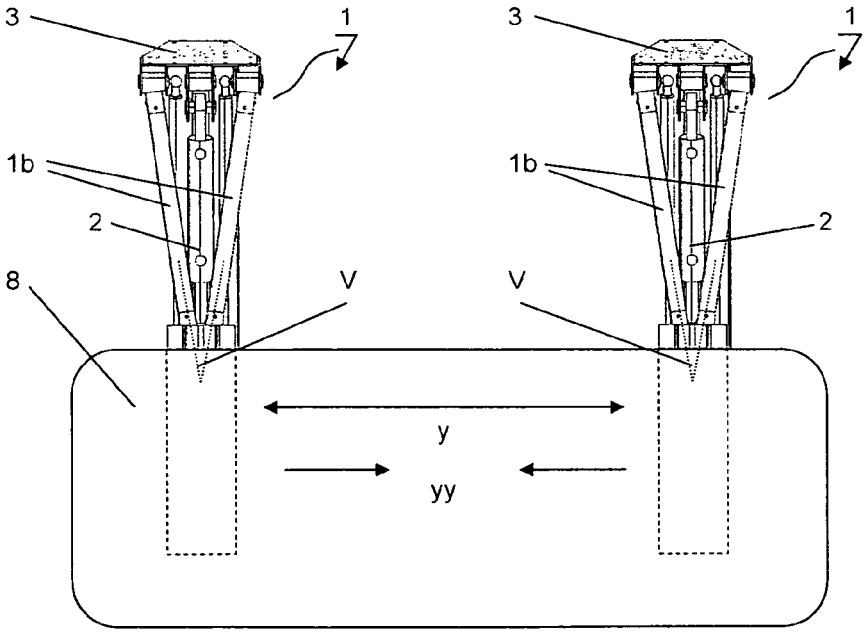
FIG. 2 shows a schematic top view of the two V-shaped pivot parts together with the platform.

FIG. 2 shows a schematic top view of the two pivot parts 1 together with the platform 8. Shown is the characteristic configuration of the pivot arms 1*b*, which are situated with respect to one another in a V shape, which is beneficial for the overall stability of the pivot part 1; it is also characteristic that the pivot arms 1*a*, 1*b* are designed as tubes instead of the usual flat sheet metal parts cut to size. The tubes may also be bent. To provide even better compensation for tolerances and avoid any slack, the two pivot parts 1 may be mounted with appropriate pretension toward one another according to arrow yy, or toward the outside according to arrow y.

FIG. 3 shows a schematic side view of a gas spring 4, which represents a blockable gas traction spring and acts to assist the active cylinder 2. Gas traction springs 4*a* have a design with a ventilation hole 18 in the piston rod 26, which is not usable in harsh outdoor environments or in an aquatic environment. For this reason, a hydrophobic filter 19 rests on the ventilation hole 18 which allows air but not water to pass through, or a bellows 20 [is used] as a pressure exchange vessel, whereby the ventilation hole 18 and the bellows 20 may be spatially separate from one another by means of a hose 21. To reliably bind moisture, a silicate agent 22 in the form of a pellet may be inserted into the bellows 20. The gas traction spring 4*a* may also be blockable; the blocking valve 23 inside the piston rod 26 is used for this purpose, and is connected to a manual trigger device, or is electrically connected by means of a solenoid 24 via the control line 25. When the active cylinder 2, whether it is operated electrically or with fluid, is thus activated, the solenoid 24 is also activated at the same time, and the gas spring 4, 4*a* is unblocked. Each lifting platform or platform 8 is blockable very well in the desired position by means of a blockable gas spring 4 or a blockable gas traction spring 4*a*. Standard gas springs typically have a blocking force of at least 10,000 N. and thus cover a broad portion of the market with regard to retaining forces, in particular in the case that multiple gas springs 4, 4*a* are used in parallel.

Even hydraulically lockable lifting platforms lose hydraulic [power], and therefore the platform 8 sinks over time, or worse, the hydraulic cylinder which activates the lock pawl loses pressure, so that secure locking is ensured to an even lesser degree. A gas spring 4, 4*a* consistently delivers a high positive pressure, and therefore a hydraulic cylinder cannot lose oil since the oil is not under pressure, thus further improving safety on a lifting platform.

Figure 4:
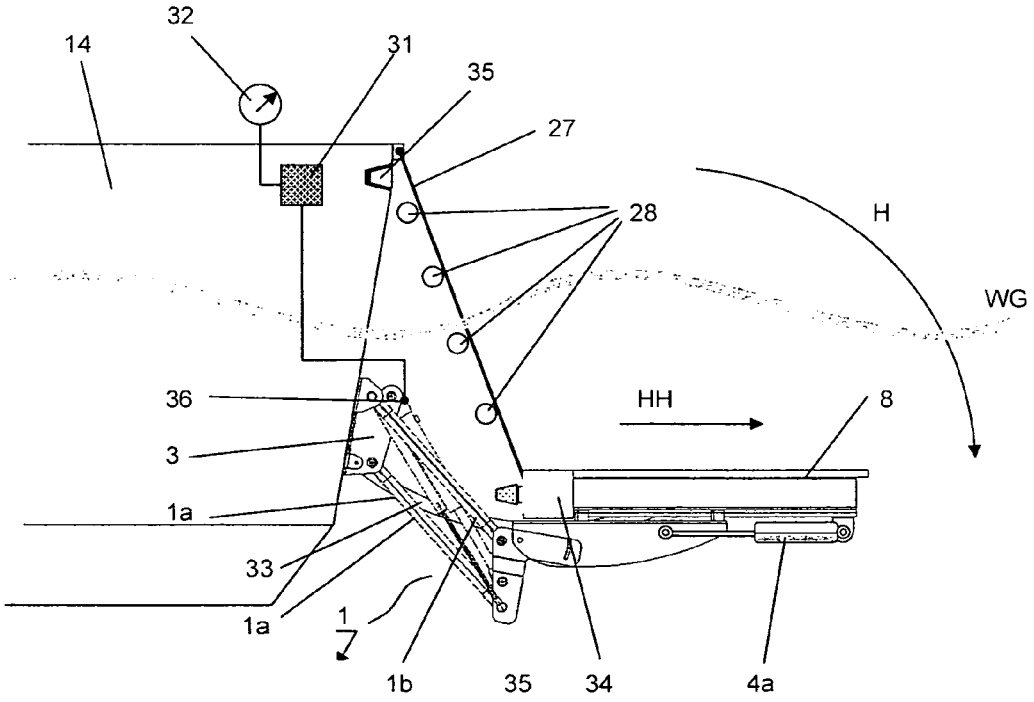
FIG. 4 shows a schematic side view of a pivot part having a platform which is additionally horizontal extendable, a personal protection safety net having integrated stairs, a seat cone, and a distance meter on the active cylinder, together with a controller and a rotational speed sensor 32, as well as a separate gas spring 4 between the platform and the platform support.

FIG. 4 shows a schematic side view of a pivot part 1 having a horizontally extendable platform 8, a personal protection safety net 27 having integrated stairs 28, and a cone 29, as well as a distance meter on the active cylinder 2, coupled to the controller 31, which also processes as an input variable by means of the rotational speed sensor 32 on the motor. A separate gas spring 4 assists with the lifting power of the pivot part 1 from above.

In order to elegantly avoid technical underwater equipment such as rudder blades or trim tabs for lowering the platform 8, a forcibly controlled horizontal displacement of the platform 8 is carried out by means of the push rod 33, which at the time completes a lift HH with respect to the lift H of the platform 8. This process may also be carried out independently by means of a horizontally acting active cylinder 2 mounted between the alignment plate 6 or support 5 and the platform 8. The displacement of the platform 8 results in a large gap between the vehicle 14 and the platform 8, and in particular for a wave surge WG or flow there is a risk that a person present on the platform 8 is pressed against the vehicle 14, and the person's body parts may collide with the technical underwater equipment. For this reason, a personal protection safety net 27 is extended, which is fastened to the vehicle 14 and to the platform 8, thus representing a safe delimitation from the stern of the vehicle. In addition, stairs may be integrated into the personal protection safety net 27, so that persons may quickly go on deck or back onto the platform.

The personal protection safety net 27 is either rolled into a roller receptacle 34 or displaceably transferred beneath the platform 8 and held under tension by a spring. If the spring is a gas spring 4, 4*a*, the platform 8 may also be raised, if necessary, by the tensile stress on the personal protection safety net 27.

Likewise, in the case of forcible control of the horizontal platform displacement HH, the platform 8 may be pulled in the direction of the bracket 3 by means of a gas traction spring 4*a* between the platform 8 and the alignment plate 6, for example, or another part of the pivot part 1, thus activating the push rod 33, which thus pushes the pivot arms 1*a*, 1*b* upwardly and thus raises the platform 8, under the assumption that the active cylinder 2 is hydraulically practically pressureless, or an electric active cylinder 2 is decoupled and thus offers less resistance.

In order to reduce the platform 8 in the most precise manner possible, and in particular against lateral pressure of the pivot part 1 in the event that the platform 8 collides with objects during mooring of the vehicle 14, a funnel 35 is present on the vehicle, into which the cone 29, which is mounted on the platform 8 or on the pivot part 1, enters, thus representing a guide and additional lateral support. The cone 29 is advantageously made of rubber or a technical plastic, and is also used for buffer damping of the rising platform 8, which ultimately docks on the vehicle 14 with the smallest possible gap, and thus allows a type of "soft close," i.e., which allows a stop of the final lift.

Instead of elastomer end position damping or end position damping integrated into the active cylinder 2, the active cylinder 2 has an integrated lift meter, which by means of the controller 31 allows, by means of the active cylinder 2, traversal of a speed ramp at any time and in any position, for example by pulse width modulation, so that a "soft start" and a "soft close" operation of the platform 8 are possible, which is useful for the comfort and safety of the persons on the platform 8. Instead of placing only proximity switches at certain locations on the pivot part 1 or on the platform 8, which are external and thus subject to soiling or damage, in this case a lift sensor 36 is placed directly in the active cylinder 2, so that any lift position H, HH is always recognizable, and each lift is correspondingly modulatable.

In addition, the lift sensor 36 is used for monitoring the position of the platform 8, and when there is a corresponding setpoint deviation, the controller 31 responds and corrects the platform 8 to the desired position. The controller 31 also has an additional input variable which includes the rotational speed: by means of the rotational speed sensor 32, the position of the platform is continuously or periodically queried during travel and corrected as needed, or for a lowered platform 8, the vehicle may deliver only a specified rotational speed with the motor engaged. At the same time, the lift sensor 36 in each active cylinder 2 is used by the controller 31 for synchronizing the two active cylinders 2.

FIG. 5 shows a geometric illustration of a pivot arm 1*a* and an active cylinder 2 of a pivot system 1 in order to thus be able to perform a lift H in the lift position at the very top U, in the lift position in the middle M, and in the lift position at the very bottom D, starting from a viewpoint from the pivot position A, and the associated active cylinder 2 in the corresponding mounting position B, and the upper pivot position C of the upper pivot arm 1*b*.

Most platform pivot systems or tailgate lifts on mobile devices have a very simple geometry which makes use of an upper pivot of the parallelogram-guided pivot arms in order to also simultaneously fasten the active cylinders for raising and lowering the pivot arms. Due to the fact that all such systems are operated via hydraulics, a sophisticated geometry for an optimized use of force is hardly an issue, since higher forces may be achieved with little effort by enlarging the piston diameter or by action of pressure on the piston. The inventive step includes not only the use of hydraulic force, but also the activation of the pivot systems 1 using an electric drive. Thus, a closer examination of the geometry is key; otherwise, such electric cylinders might require a much larger electric motor and correspondingly dimensioned gearing, as well as the need for designing the spindle for unnecessarily high lifting forces, possibly resulting in a system which is extremely cumbersome and costly. At the same time, however, for all pivot systems 1 the lifting forces have an influence not only on the active cylinders 2, but also on the pivot bearings, and ultimately, on the design of the overall system, which in turn represents a weight issue.

It is therefore beneficial to design the geometry for such pivot systems 1, whether they have a hydraulic or electric drive, in a more precise manner in order to obtain the best possible geometry under the limited parameter options, such as the length of the pivot arm 1*a*, which has the same length as the pivot arm 1*b* (not shown here), limited lift H, and limited overall height, i.e., the distance between the pivot arms 1*a*, 1*b* in the form of a parallelogram, as well as the incorporation of the active cylinder 2 into the pivot mechanics, in order to keep the required working forces as low as possible at a constant lifting force. By use of an Excel table, all relevant parameters may be variably entered at any time, such as the length of the pivot arm 1*a*, the engagement point of the active cylinder 2 with same, the distance of the active cylinder 2 from the vehicle stern, the start and end angles, the coordinates of the pivot lever 1*a* and of the active cylinder 2 in the coordinates A, B, C and position axis x, z, in order to link a triangular relationship and thus compute in all positions of the lift H the corresponding applications of force for a certain weight to be lifted, as well as to take the installation length of the active cylinder 2 into account in order to ensure that the available lift length may also be achieved in practice with the effective installation dimensions.

It has been shown that a flatly installed active cylinder 2 results in a considerable number of advantages compared to an active cylinder installed in an inclined manner; in trucks, an inclined installation of an active cylinder 2 is usually not possible anyway. With regard to a flatly installed active cylinder 2, it has been shown that a separate, correctly placed mounting position B for the active cylinder 2, instead of at the usual upper pivot position C of the pivot lever 1*b*, represents a significant added advantage, in particular because the mounting position B, which is situated on the position axis x of the pivot lever 1 but is at an axial distance from the pivot position C, and the mounting position B is not situated lower than the pivot position C, i.e., the position axis z. The mounting position B behind the pivot position C also refers to the pivot system 1 illustrated in FIG. 3, having the bracket 3 which is mounted on a vehicle, at which the pivot position A for the pivot lever 1*a* and the mounting position B for the active cylinder 2 is achieved, and is mounted on the downstream side and above the platform 8.

By means of the clearly defined position of a flat active cylinder 2 having an angular position of less than 40°, measured in the middle position, i.e., in the lift position M, and a mounting position B which preferably is not situated beneath the position axis z of the pivot position C of the pivot arm 1, and at the same time the mounting position B is separated by a distance from the pivot position C, an application of force of greater than 40% on the active cylinder 2 may thus be spared without making any changes to the length of the pivot arm 1*a*, 1*b* or to the lift H.

Ideally, for a pivot part 1 in vehicles 14 in which corresponding dimensional constraints are present, it has been shown that the mounting position B of the active cylinder 2 at the center part 3*a* is between 10% and 15% of the bracket 3 downstream from the mounting position A of the pivot lever 1*a*, where the percentage refers to the length of the pivot arm 1*a*.

Placement of the mounting position B of the active cylinder 2 beneath the position axis z of the pivot position C increases only the required lifting forces; placement of the mounting position B of the active cylinder 2 above the position axis z of the pivot position C makes little sense, since the greatest possible distance between the pivot position A and the pivot position C, which are part of a parallelogram and which form the pivotably supported pivot arms 1*a*, 1*b*, should always be utilized, the distance ultimately being limited only by the installation space for the pivot system 1. In this limited available installation space, the mounting position B should therefore preferably be situated on the position axis z of the pivot position C, and in the case that the pivot position C could be slightly higher with respect to the distance from the pivot position A, the mounting position B should then be situated at the same height, so that the mounting position B of the active cylinder 2 is preferably always at the same height, i.e., situated on the position axis z of the pivot position C. By use of the Excel table and the input fields and computation information contained therein, the coordinates of the position axis x may thus be easily defined. At the bottom of the table the cylinder forces may be read off, for example, in three relevant lift positions. A displacement of the engagement point on the active cylinder 2 on the opposite side is necessary if the cylinder dimensions are no longer installable with respect to the lift of the piston rod, and this is likewise displayed and a corresponding entry field for displacing the active cylinder 2 is available.

Of course, the invention is not limited just to the exemplary embodiments illustrated and described.

LIST OF REFERENCE NUMERALS

1 Pivot part
1*b* Upper pivot arm
1*a* Lower pivot arm
2 Active cylinder
3 Bracket
3*a* Center part
4 Gas spring
4*a* Gas traction spring
5 Support
6 Alignment plate
7 Displacement element
8 Platform
9 Wedge
10 Pivot
11 Rotational axis
12 Adjustment point
13 Angle bracket
14 Vehicle
15 Bearing
16 Spacer element
17 Bearing bolt
18 Ventilation hole
26 Piston rod
19 Filter
20 Bellows
21 Hose
22 Silicate agent
23 Blocking valve
24 Solenoid

25 Control line
26 Piston rod
27 Personal protection safety net
28 Stairs
29 Cone connection
31 Controller
32 Rotational speed sensor
33 Push rod
34 Roller receptacle
35 Funnel
36 Lift sensor
H Lift
A Lower pivot position
C Upper pivot position
B Mounting position
U, M, D Lift positions
x, z Position axis
y Compressive pretension
yy Tensile pretension
WG Wave surge

The invention claimed is:

1. Pivot system, comprising:
two upper pivoting arms;
one lower pivoting arm, wherein:
the upper pivoting arms and the lower pivoting arm form a parallelogram,
the upper pivoting arms form a V-shaped spread; and
the lower pivoting arm is spaced from the upper pivoting arms;
an active cylinder connected to at least one of the pivoting arms; and
a platform that is connected to at least one of the pivoting arms.

2. Pivot system according to claim 1, wherein gas springs and/or a personal protection safety net is connected to the platform.

3. Pivot system according to claim 2, wherein the active cylinder in a mode of lowering the platform acts against an elastic force of the gas springs or of a metal or plastic spring, and during lifting, the gas springs or the metal or plastic spring assists the active cylinder.

4. Pivot system according to claim 2, wherein the personal protection safety net has integrated stairs, and assists the active cylinder with a lifting action by means of an integrated roll-up spring or tension spring, and the personal protection safety net is wound up or is longitudinally displaceable beneath the platform.

5. Pivot system according to claim 2, wherein the platform undergoes a curved lift by means of the pivoting arms, and undergoes a horizontal lift by means of a push rod, activated by the active cylinder and/or the gas springs.

6. Pivot system according to claim 2, wherein the platform generates a lifting force on the pivot system by means of the gas springs mounted between the platform and a support, and undergoes an upward lift and a horizontal lift.

7. Pivot system according to claim 2, wherein the gas springs have a filter at a ventilation hole, or has a bellows, and/or a silicate agent is integrated into the bellows, and/or a hose is situated between the ventilation hole and the bellows.

8. Pivot system according to claim 2, wherein the gas springs have a blocking valve, and the blocking valve is unblocked by means of a solenoid.

9. Pivot system according to claim 2, wherein a mounting position of the lower pivoting arm represents and is situated practically on or above an upper position axis of the upper pivoting arms, and is separately supported on the position axis at a distance downstream from a pivot position, and the active cylinder is situated between the upper pivoting arms and the lower pivoting arm at an angle of less than 40° at one-half the distance from the lift, and/or the pivot system has at least one gas spring or one active sylinder between the bracket and a support or an alignment plate, or between the support or the alignment plate or the lever and the platform, and the platform is adjusted by means of a wedge and the alignment plate.

10. Pivot system according to claim 1, wherein the active cylinder is elastically supported, and/or an elastic bearing is mounted between a support and the platform and/or a cone connection to a funnel is provided between the platform and a vehicle.

11. Pivot system according to claim 1, wherein the active cylinder has an integrated lift sensor, and the lift sensor is connected to a controller, which also processes data of a rotational speed sensor, and the controller may thus synchronize the active cylinder by means of the lift sensor in the active cylinder, and the controller is able to traverse a speed ramp in any lift position by means of a pulse width modulation program and by use of the lift sensor.

12. Pivot system according to claim 11, wherein the lift sensor actively measures during travel of a vehicle, and in the event of a certain deviation from a setpoint value, the controller activates the active cylinder for corrective measures.

13. Pivot system according to claim 12, wherein the active cylinder is an electric active cylinder having a self-locking spindle, and in the event of failure a lift is thus manually adjusted at the same time by means of mechanical synchronization for the active cylinder, or the active cylinder is an electric active cylinder having a nonself-locking spindle, and in the event of failure the gas spring produces a lift by unblocking a blocking valve, or the active cylinder is a hydraulic active cylinder, and in the event of failure the gas spring produces a lift by means of an activatable depressurization valve on a hydraulic system and by unblocking the blocking valve, and lifts the platform.

14. Pivot system according to claim 1, wherein the active cylinder has an offset positioning of a pivot with respect to a bracket, and the pivot is situated at a distance of between 7 and 15 cm from a rotational axis, and is a function of a length of the pivoting arms, a lift, and a fastening point of the active cylinder to the pivoting arms or to a support.

15. Pivot system according to claim 1, wherein the lower pivoting arm and the upper pivoting arms together form a tripod.

16. Pivot system according to claim 15, wherein active cylinder is located within the tripod.

* * * * *